US005544753A

United States Patent [19]

Monica

[11] Patent Number: 5,544,753

[45] Date of Patent: Aug. 13, 1996

[54] KIT FOR THE CARE OF BACK AILMENTS

[76] Inventor: Julianne H. Monica, 1616 Kennedy Blvd., Union City, N.J. 07087-1912

[21] Appl. No.: 354,754

[22] Filed: Dec. 8, 1994

[51] Int. Cl.[6] ..... B65D 85/00

[52] U.S. Cl. ..... 206/570; 206/232

[58] Field of Search ..... 206/223, 232, 206/438, 570, 803

[56] References Cited

U.S. PATENT DOCUMENTS

| | | | |
|---|---|---|---|
| 3,981,398 | 9/1976 | Boshoff | 206/570 |
| 4,250,998 | 2/1981 | Taylor | 206/570 |
| 4,429,793 | 2/1984 | Ehmann | 206/570 |
| 4,523,679 | 6/1985 | Paikoff et al. | 206/570 |
| 4,573,581 | 3/1986 | Galloway et al. | 206/570 |
| 5,117,981 | 6/1992 | Crawford et al. | 206/570 |
| 5,377,841 | 1/1995 | Varon | 206/570 |
| 5,390,791 | 2/1995 | Yeager | 206/570 |

*Primary Examiner*—Jimmy G. Foster
*Attorney, Agent, or Firm*—Terrance L. Siemens

[57] ABSTRACT

A kit for the care of either lumbar or cervical back ailments is disclosed. The kit is designed to be given to the patient by either a caregiver or other outlet, such as a retail establishment or clinic, and allows the user to treat the most common forms of discomfort that arise from the problems. The kit includes an instruction videotape and a written manual to inform the user as to the proper use of the elements in the kit. Additionally, the kit includes an analgesic massage ointment, support devices, ice packs, and the like.

10 Claims, 3 Drawing Sheets

KIT FOR THE CARE OF BACK AILMENTS

BACKGROUND OF THE INVENTION

1. Field of the Invention

The present invention relates to medical kits. More specifically, it relates to a spinal care kit designed so that the user can treat cervical and lumbar back problems at home. The kit includes various pain relief compounds, support devices, and instructions.

2. Description of the Prior Art

Back problems cause many adverse effects to society. They are one of the most common causes of missed work, and can be very expensive for the sufferer or the insurer thereof when treatment is deferred or is long term. The present invention seeks to provide a kit that a health care provider can supply to patients that allows them to alleviate most of the common symptoms associated with lumbar and cervical back problems, especially in relation to disc problems. A number of patents were uncovered during a search that relate to the invention.

First is U.S. Pat. No. 2,648,366 issued on Aug. 11, 1953 to Higbee et al. This discloses a nurse's bag.

U.S. Pat. No. 2,804,969 issued on Sep. 3, 1957 to Barnett discloses a pocket sized container with a selection of diagnostic equipment, therapeutic instruments, and medications.

U.S. Pat. No. 4,828,113 issued on May 9, 1989 to Friedland et al. discloses a dental treatment kit for persons untrained in dentistry. The kit includes instruments and medications.

U.S. Pat. No. 5,117,981 issued on Jun. 2, 1992 to Crawford et al. discloses a prepackaged medical kit with a tourniquet and rolled gloves.

Lastly, U.S. Pat. No. 5,230,679 issued on Jul. 27, 1993 to Olsen discloses a leg lifting and exercising device. The device has a non-slip covering for foot placement and two handles.

None of the above inventions and patents, taken either singly or in combination, is seen to describe the instant invention as claimed.

SUMMARY OF THE INVENTION

The present invention is a kit for the care of either lumbar or cervical back ailments. The kit is designed to be given to the patient by the caregiver, retail outlet, or clinic, and allows the user to treat the most common forms of discomfort that arise from the problems. The kit includes instruction videotapes and written manuals to inform the user as to the proper use of the elements in the kit. Additionally, the kit includes, analgesic massage ointment, support devices, ice packs, and the like.

Accordingly, it is a principal object of the invention to provide a kit for the treatment of cervical or lumbar back ailments that can be given to the ailing person by the caregiver, a retail outlet, a clinic or like outlet for use at home and that contains instructions for use of the elements contained therein.

It is another object of the invention to provide a kit for the treatment of common back ailments that allows the user to relieve some of the chronic pain that accompanies these back problems.

It is an object of the invention to provide improved elements and arrangements thereof in an apparatus for the purposes described that is inexpensive, dependable and very effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

The present invention is a kit for the relief of lumbar or cervical back pain. This pain can be muscular, skeletal, or neurologic. The invention addresses a need for a self-contained kit that can be provided to a sufferer that allows the user to properly treat the pain.

Figure 1:
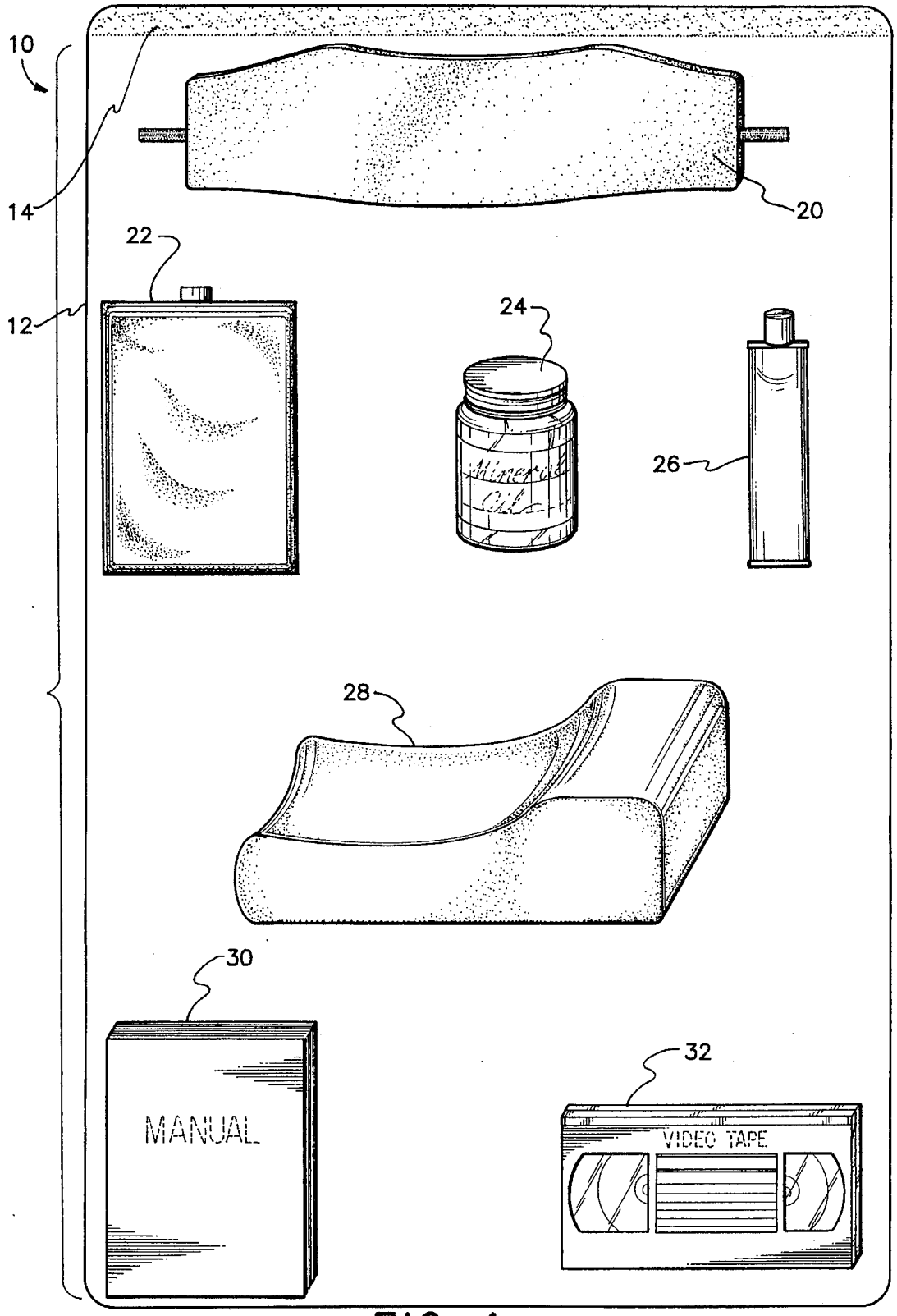
FIG. 1 is a view of the various elements that comprise the preferred cervical care kit of the present invention.

Referring to FIG. 1, there is seen the first embodiment of the invention which is indicated at 10. The elements in the kit are shown placed on a rollable sheet 12 that includes a hook and loop type fastening portion 14 to allow the container to be securely closed. Alternately, the elements of the kit may be placed in a box (not shown) to be securely closed. It should be understood though, that various other types of containment devices could be used without departing from the spirit of the invention. The discussion now turns to the elements of the kit.

Indicated at 20 is a cervical collar. An example of one such type of collar is manufactured by Foot Levelers Inc. of Roanoke, Va. At 22 there is an ice pack. These are known devices that can be placed within a freezer or refrigerator to lower the temperature to a desired level. This would be supplied in both embodiments of the invention and when applied to either the neck or the lower back, aids in reducing inflammation and stiffness due to over-exertion. An example of this product is manufactured by GAM Industries of Petersburg, Va. and is marketed under the name "Cold Compress". Shown at 24 is a mineral ice liniment and analgesic balm. This is a massage gel that is used to increase circulation with a warming and cooling effect. A gel of this type is marketed under the name "Kool Comfort" and is manufactured by Dee Cee Labs of White House, Tenn. Indicated at 26 is a vitamin/mineral supplement that would be supplied in both embodiments of the invention. This supplement is a combination of components that allows for strengthening and healing. An example of this type of compound is marketed under the name "Formula 303" and is also manufactured by Dee Cee Labs of White House, Tenn. Indicated at 28 is a cervical support pillow that would be included in the embodiment of the invention directed at cervical ailments. One such orthopedic pillow is the Cervical Sleeping Pillow manufactured by Continental S.E.L. of Ocala, Fla. These pillows provide support and stability for the neck area when the patient is in a prone or supine position. Indicated at 30 and 32 in FIG. 1 are the instructional means that would be supplied in both embodiments of the invention. These would consist of an instruction manual 30 and a videotape 32 that would show the proper use of the various elements included in the kits. The videotape 32 would show proper application of the various materials and would provide motivation for their use. Additionally, this tape could demonstrate exercises that would promote better flexibility and maintenance of the spinal regions. The manual 30 would have a reference index, and would include further diagrams to allow proper utilization of the kits.

Figure 2:
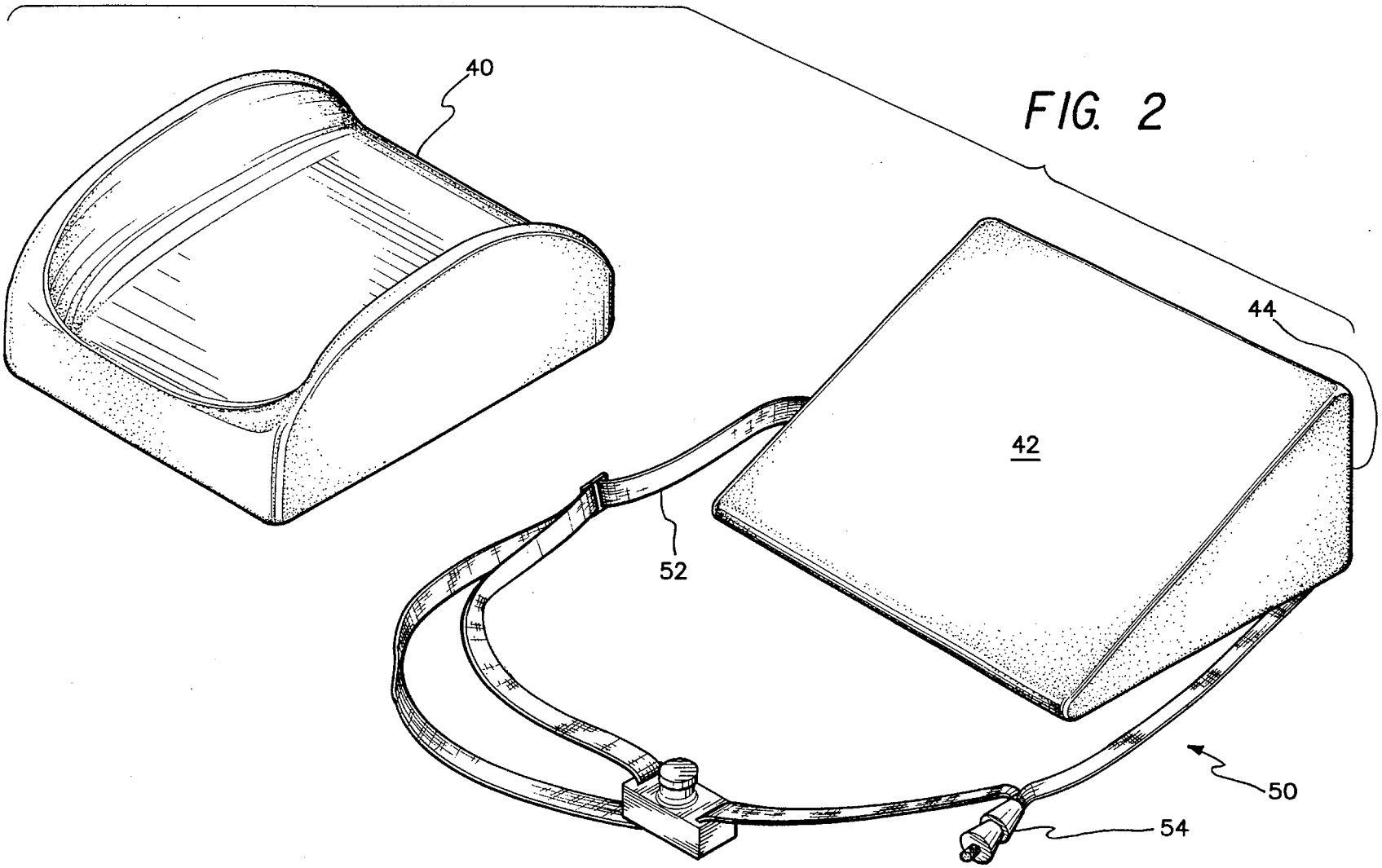
FIG. 2 is a perspective view of the additional elements that replace or are included in the lumbar care kit.

Turning now to FIG. 2, there are shown elements that would be included in the lumbar embodiment of the invention. 40 is a back lumbar support that assists in stabilizing and immobilizing the lumbar region. An example of this type of device is the "Uni-Foam Adjustable" manufactured by Scott Specialties of Belleville, Kans. 42 indicates a knee support pillow. This aids the user while lying down by keeping the knees in a bent position so that there is less strain on the lumbar region of the patient. The knees are placed on top of the wider area 44 of the pillow and descend down the decline.

Figure 3:
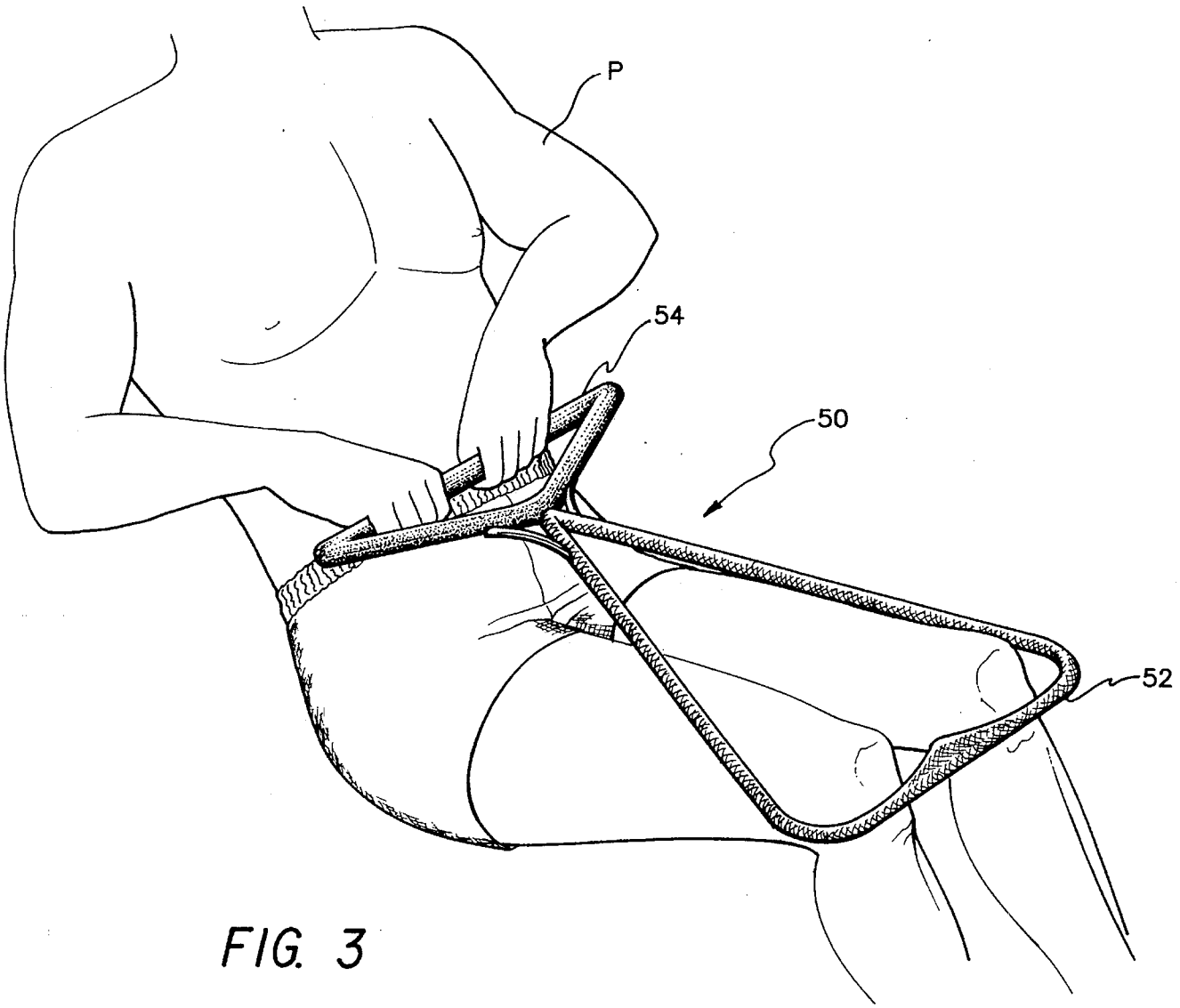
FIG. 3 is a perspective view of the stretching handle of the lumbar kit embodiment of the present invention.

People suffering from lumbar pain frequently derive relief from raising their knees, thus stretching the pelvis downward and flattening the lumbar segments. Reaching the knees to perform this maneuver is often painful. Thus, a stretching handle 50 is included in the lumbar kit of the present invention. The knee engaging portion 52 of the device is placed around the knees of patient P, and the handle portion 54 is pulled to raise them into the desired position as seen in FIG. 3. The user is usually in the supine position when using exercise means 50. The handle 50 would preferably be made of a resilient material that would nonetheless hold the shape generally shown in FIG. 3. The handle portion 54 and the knee engaging portion 52 could be made, if desired, from molded plastic or other non-deformable material. It should be understood, though, that other shapes and materials could be used to accomplish the raising of the users knees as described.

It is to be understood that the present invention is not limited to the sole embodiment described above, but encompasses any and all embodiments within the scope of the following claims.

I claim:

1. A kit for the care of back ailments comprising:

ice pack means dimensioned such that said ice pack can be placed on a desired location on a user's body;

dietary supplement, said supplement compounded to promote healing;

analgesic balm; and containment means for the securing of said ice pack, said analgesic balm, and said dietary supplement.

2. The kit according to claim 1, further including a cervical support pillow for support of the user's cervical region when lying prone or supine and where said containment means additionally secures said support pillow.

3. The kit according to claim 2, further including instruction means for informing the user of the proper use of said kit and where said containment means additionally secures said instruction means.

4. The kit according to claim 3, where said instruction means comprises a videotape and printed material.

5. A kit for the care of back ailments comprising:

ice pack means dimensioned such that said ice pack can be placed on a desired location on a user's body;

dietary supplement, said supplement compounded to promote healing;

knee support means for the support of the user's knees in a raised position while the user is in a generally supine position;

analgesic balm; and containment means for the securing of said ice pack, said dietary supplement, said analgesic balm, and said knee support means.

6. The kit according to claim 5, further including a lumbar support for stabilization of the user's lumbar region and where said containment means additionally secures said lumbar support.

7. The kit according to claim 6, further including instruction means for informing the user of the proper use of said kit and where said containment means additionally secures said instruction means.

8. The kit according to claim 7, where said instruction means comprises a videotape and printed material.

9. The kit according to claim 7, further including an exercise means for stretching the pelvis downward and flattening the lumbar segments.

10. The kit according to claim 9, wherein said exercise means comprises;

a handle portion for gripping by the user;

a knee engaging portion, which is wider than said handle portion, for engaging the users knees;

a resilient connecting means for connecting said handle portion and said knee engaging portion.

* * * * *